US012595924B2

(12) United States Patent
Goel et al.

(10) Patent No.: US 12,595,924 B2
(45) Date of Patent: Apr. 7, 2026

(54) SYSTEM AND METHOD FOR PROVIDING COOLING DURING REFRIGERANT LEAK

(71) Applicant: Lennox Industries Inc., Richardson, TX (US)

(72) Inventors: Rakesh Goel, Irving, TX (US); Siddarth Rajan, Addison, TX (US); Vijay Kumar Sathyamurthi, Frisco, TX (US)

(73) Assignee: Lennox Industries Inc., Richardson, TX (US)

( * ) Notice: Subject to any disclaimer, the term of this patent is extended or adjusted under 35 U.S.C. 154(b) by 416 days.

(21) Appl. No.: 18/453,015

(22) Filed: Aug. 21, 2023

(65) Prior Publication Data

US 2025/0067453 A1 Feb. 27, 2025

(51) Int. Cl.
*F24F 11/36* (2018.01)
*F24F 11/52* (2018.01)
*F24F 11/65* (2018.01)

(52) U.S. Cl.
CPC ..... *F24F 11/36* (2018.01); *F24F 11/52* (2018.01); *F24F 11/65* (2018.01)

(58) Field of Classification Search
CPC ..... F24F 11/36; F24F 11/89; F24F 2110/65; F24F 1/0041; F24F 11/30; F24F 11/64; F24F 11/65; F24F 11/32; F24F 11/49; F24F 11/63; F24F 11/00; F24F 11/526; F24F 2110/50; F25B 2500/222; G05B 13/041; G05B 13/024; G05B 2219/2614; G05B 19/042
See application file for complete search history.

(56) References Cited

U.S. PATENT DOCUMENTS

| | | | | |
|---|---|---|---|---|
| 11,125,457 | B1 * | 9/2021 | Alfano | F24F 11/36 |
| 11,435,101 | B2 * | 9/2022 | Branson | F24F 1/0018 |
| 11,573,149 | B2 * | 2/2023 | Gupte | G01M 3/16 |
| 11,859,837 | B2 | 1/2024 | Sadanandan et al. | |
| 11,971,184 | B2 | 4/2024 | Branson et al. | |
| 11,976,830 | B2 * | 5/2024 | Watanabe | F25B 41/24 |
| 12,460,832 | B2 * | 11/2025 | Bhardwaj | F24F 11/86 |
| 2002/0178738 | A1 * | 12/2002 | Taira | F24F 11/30 62/181 |
| 2013/0213068 | A1 * | 8/2013 | Goel | F25B 49/005 29/890.035 |
| 2019/0170385 | A1 * | 6/2019 | Maddox | F24F 1/022 |

(Continued)

*Primary Examiner* — Darrin D Dunn
(74) *Attorney, Agent, or Firm* — Baker Botts L.L.P.

(57) ABSTRACT

A refrigeration system to provide cooling during refrigerant leak is disclosed. The system detects a refrigerant leak by detecting that a refrigerant concentration is more than a threshold concentration on at least two occasions. The system executes a mitigation plan until the concentration of refrigerant is less than the threshold concentration. The system determines if it is operated in a safe mode, where in the safe mode, a blower of the system is set to operate continuously. When the system is in the safe mode, the system determines a number of times where the concentration of refrigerant exceeded the threshold concentration. In response to determining that the number of times where the concentration of refrigerant exceeded the threshold concentration is more than the threshold value, the system operate the HVAC system in the safe mode and communicate a first alert message.

20 Claims, 3 Drawing Sheets

(56) References Cited

U.S. PATENT DOCUMENTS

| | | | | |
|---|---|---|---|---|
| 2019/0186769 | A1* | 6/2019 | Zimmermann | F25B 41/34 |
| 2020/0141601 | A1* | 5/2020 | Weinert | F25B 41/00 |
| 2021/0095876 | A1* | 4/2021 | Branson | F24F 1/0018 |
| 2021/0108819 | A1* | 4/2021 | Chen | G01N 21/3504 |
| 2022/0049883 | A1* | 2/2022 | Alfano | F25B 45/00 |
| 2024/0068685 | A1* | 2/2024 | Lowrimore | F24F 11/77 |
| 2024/0200843 | A1* | 6/2024 | Wada | F25B 41/20 |
| 2024/0219064 | A1* | 7/2024 | Asanuma | F24F 11/36 |
| 2024/0230129 | A1 | 7/2024 | Branson et al. | |
| 2025/0035356 | A1* | 1/2025 | Manohar | F25B 49/02 |
| 2025/0067453 | A1* | 2/2025 | Goel | F24F 11/36 |
| 2025/0216102 | A1* | 7/2025 | Sathyamurthi | F24F 11/80 |
| 2025/0230940 | A1* | 7/2025 | Bhardwaj | F24F 11/36 |
| 2025/0230942 | A1* | 7/2025 | Bhardwaj | F24F 11/65 |

* cited by examiner

SYSTEM AND METHOD FOR PROVIDING COOLING DURING REFRIGERANT LEAK

TECHNICAL FIELD

The present disclosure relates generally to heating, ventilation, and air conditioning (HVAC) systems and methods of their use, and more specifically to a system and method for providing cooling during refrigerant leak.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air. During operation, refrigerant may leak from the working-fluid conduit subsystem or from one or more components.

SUMMARY

The system described in the present application provides several practical applications and technical advantages that overcome the current technical problems described herein. The following disclosure is particularly integrated into a practical application of improving refrigeration techniques by providing cooling during a refrigerant leak.

In general, the disclosed system improves refrigeration techniques by enabling cooling even when a refrigerant leak is detected. The refrigerant may be flammable or at least mildly flammable, such as A2L. Therefore, it is crucial to detect and address A2L refrigerant leaks in a timely manner. In one approach, when a refrigerant leak is detected at any component of an HVAC system, the cooling unit (e.g., compressor circuits) of the HVAC system is switched off and the blower is switched on to dilute the refrigerant concentration that is present within the HVAC system. However, this approach suffers from several drawbacks. For example, switching off the cooling unit of the HVAC system leads to a temperature rise in a room where the HVAC system is deployed, and therefore, discomfort for the people in the room. In another example, with this approach, after the blower is switched on, the blower causes airflow from within the HVAC system to the outside-which reduces the refrigerant concentration. This operation may be referred to as a mitigation plan to dilute the refrigerant concentration. In response to detecting that the refrigerant concentration is diluted, the blower may be switched off and the compressor circuit (that is associated with the refrigerant leak) may be switched back on. However, this refrigerant dilution may be temporary if the refrigerant leak is consistent and/or the refrigerant leak rate is significant. In other words, if the refrigerant leak is consistent and/or the refrigerant leak rate is significant, the refrigerant concentration will increase over time. In some cases, the mitigation plan cycle may repeat multiple times when the refrigerant leak is consistent and/or the refrigerant leak rate is significant. Current technology does not provide a solution to address multiple repetitions of the mitigation plan cycles. As a result, the refrigerant leakage will persist, and the blower may continue to be switched on and off in the mitigation plan cycles. This leads to degradation of the blower, compressor circuit, and other components that are involved in the cooling operation and the mitigation plan.

This disclosure contemplates an unconventional system and method configured to provide cooling with one or more compressor circuits HVAC system during A2L (or other classes of flammable or mildly flammable) refrigerant leak. The disclosed system is configured to detect a number of times that refrigerant leak has occurred with respect to compressor circuit(s) within the HVAC system. The number of times occurrence of the refrigerant leak may be one, two, three, four, or any suitable number. If it is determined that the number of times that refrigerant leak has occurred is more than a threshold value, the disclosed system may operate the HVAC system in safe mode. The safe mode may be a mode of operation of the HVAC system in which the blower operates continuously. The disclosed system may continue to monitor refrigerant leaks at the compressor circuit(s). If a subsequent refrigerant leak is detected while the HVAC system is operating in the safe mode, the disclosed system may determine that the leak is significant enough such that even if the blower is switched on, it is not enough to dilute the refrigerant concentration or accumulation. In response, the disclosed system may transmit an alert message, for example, to a user device associated with a technician to provide a service to the HVAC system.

Accordingly, the disclosed system provides a practical application of improving refrigeration techniques by allowing cooling even if an A2L refrigerant leak is detected. For example, if the HVAC system is a multi-compressor system, the system may switch on the blower as well as provide cooling with one or more compressors upon receiving a cooling request from a user. In another example, if the HVAC system is a single-compressor system, the disclosed system may keep the faulty compressor circuit on to provide cooling and also keep the blower on. Thus, the blower may continue to dilute the refrigerant concentration to bring the refrigeration concentration to less than the threshold concentration according to safety compliance standards to keep the HVAC system in a safe condition and not trigger the refrigerant detection sensors to detect refrigerant leaks.

In certain embodiments, an HVAC system comprises a blower, a refrigerant detection sensor circuit, and one or more processors. The blower is positioned in a duct system, wherein the blower is configured to move airflow across an indoor coil and out of the duct system. The refrigerant detection sensor circuit is configured to detect a concentration of refrigerant in a volume. The one or more processors is operably coupled with the refrigerant detection sensor. The one or more processors could be operably coupled to the refrigerant detection sensor, could be part of the sensor, a separate control board connected to the sensor, or reside in both, the sensor and a separate control board. The one or more processors is configured to perform the following operation for at least two occasions. The one or more processors is configured to obtain information related to the detected concentration of the refrigerant in the volume. The one or more processors is further configured to compare the detected concentration of refrigerant with a threshold concentration. The one or more processors is further configured to determine that the detected concentration of refrigerant exceeds the threshold concentration. The one or more processors is further configured to execute a mitigation plan until the detected concentration of refrigerant is less than the threshold concentration. The one or more processors is further configured, in response to determining that the HVAC system does not operate in a safe mode, to determine the number of times where the detected concentration of refrigerant exceeded the threshold concentration, determine whether the number of times where the detected concentration of refrigerant exceeded the threshold concentration is more than a threshold value, and in response to determining that the number of times where the detected concentration of refrigerant exceeded the threshold concentration is more than the threshold value, operate the HVAC system in the safe mode and communicate a first alert message, wherein the first alert message indicates a refrigerant leak is detected while the blower is turned on.

Certain embodiments of this disclosure may include some, all, or none of these advantages. These advantages and other features will be more clearly understood from the following detailed description taken in conjunction with the accompanying drawings and claims.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
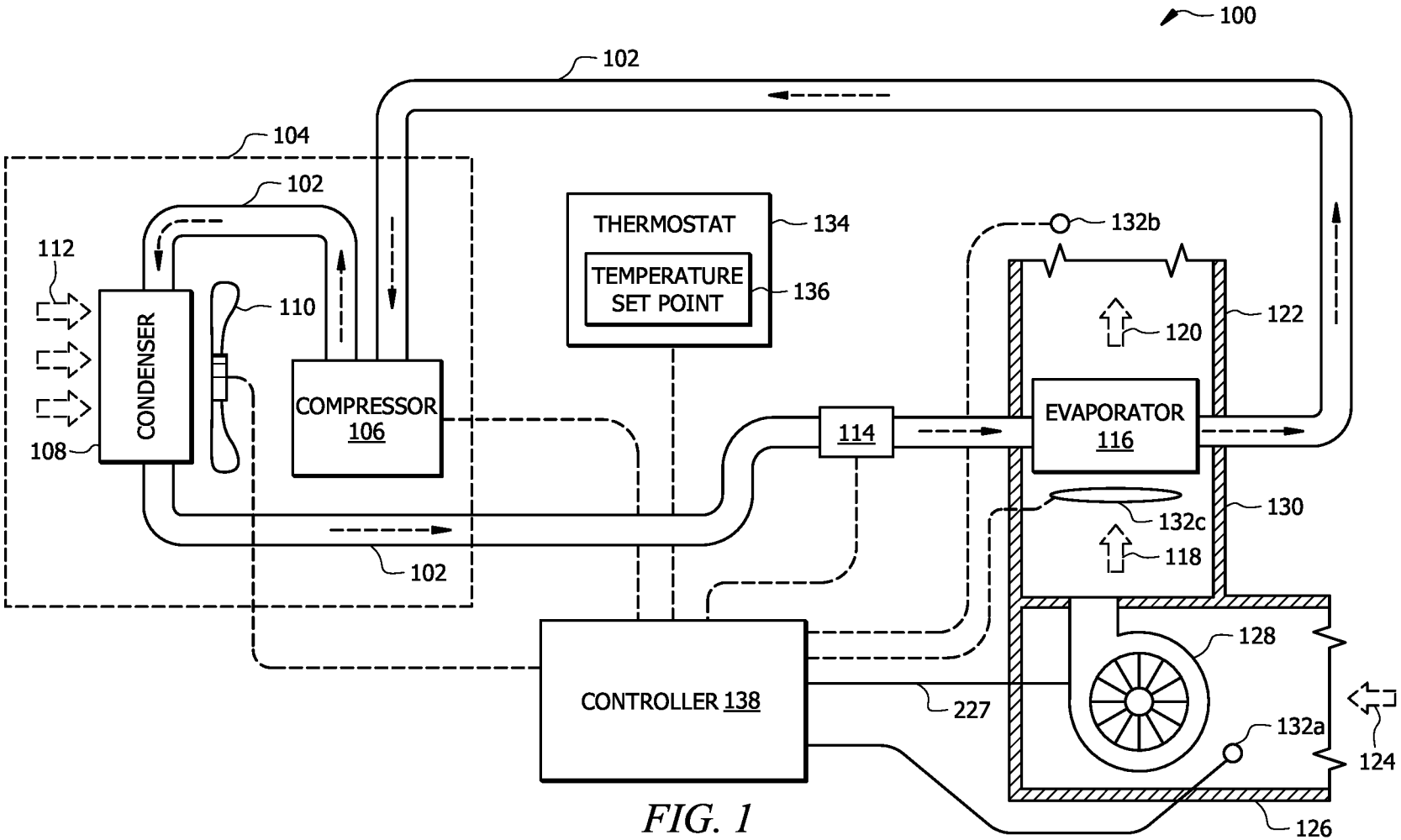
FIG. 1 illustrates a diagram of an example HVAC system.
Figure 2:
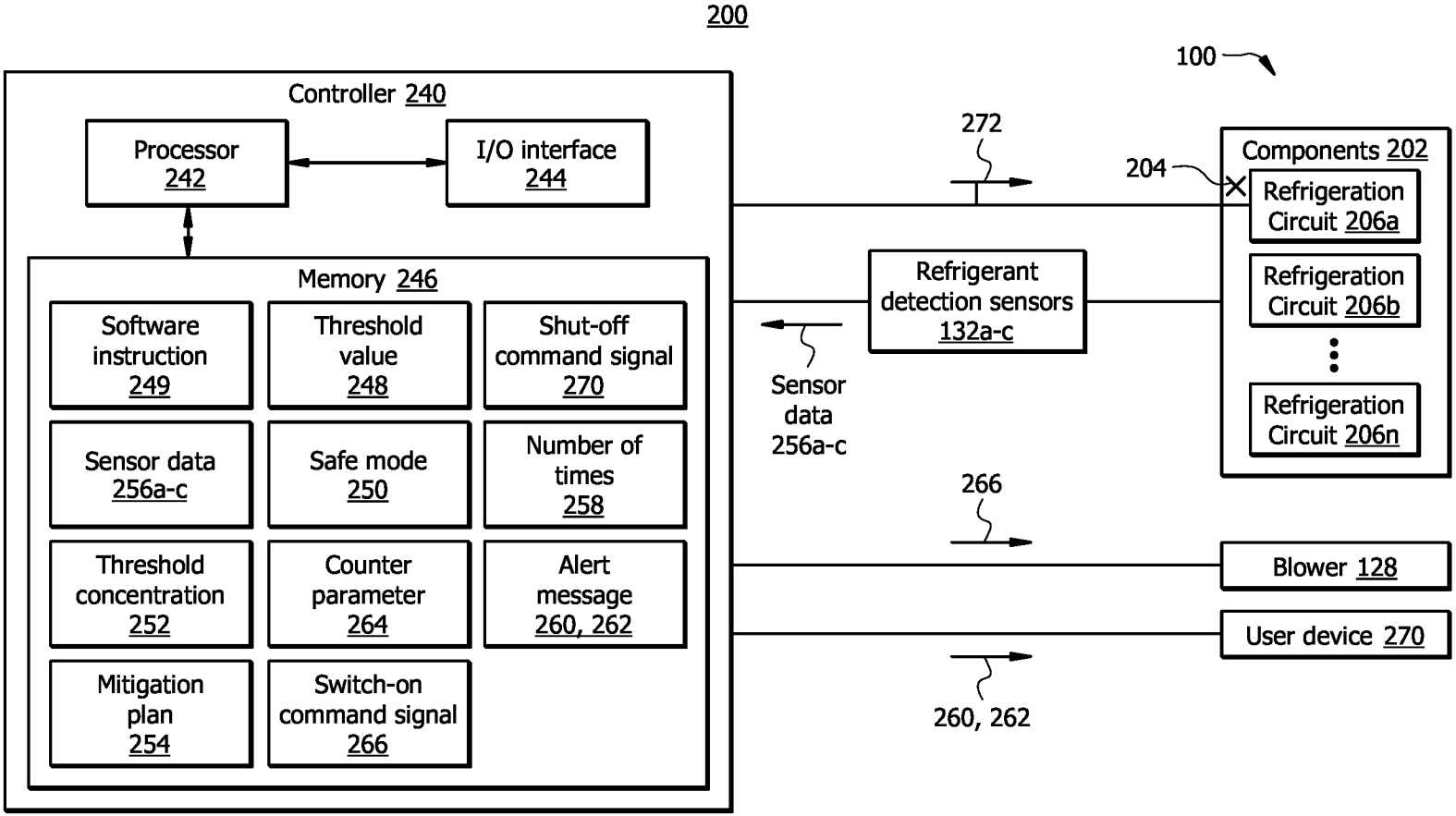
FIG. 2 illustrates a diagram of an example system configured to provide cooling during refrigerant leak in the HVAC system of FIG. 1.
Figure 3:
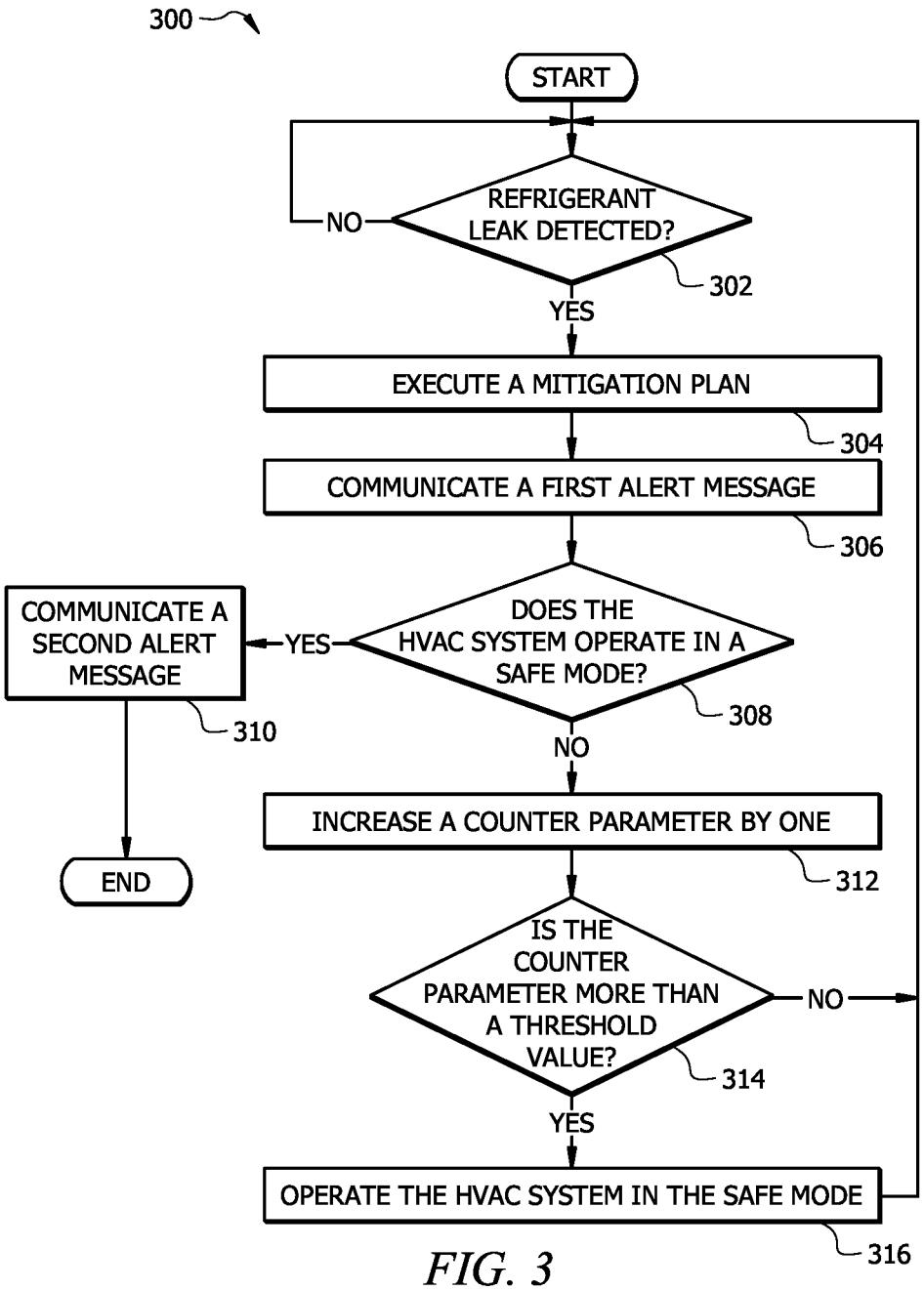
FIG. 3 illustrates a flowchart illustrating an example method for providing cooling during refrigerant leak in the HVAC system of FIG. 1.

As described above, previous technologies fail to provide an efficient, secure, and reliable solution for providing cooling during refrigerant leak in a refrigeration system, for example, in Heating, Ventilation, and Air Conditioning (HVAC) systems. Embodiments of the present disclosure and its advantages may be understood by referring to FIGS. 1 through 3. FIGS. 1 through 3 are used to describe systems and methods for providing cooling during refrigerant leak in the HVAC system.

System Overview

FIG. 1 illustrates a schematic diagram of an embodiment of an HVAC system 100 that is configured to regulate a temperature of a space. The HVAC system 100 conditions air for delivery to a conditioned space. Various components of the HVAC system 100 may be motor-driven components including, but not limited to, the compressor 106, the fan 110, and the blower 128, described in greater detail below. The conditioned space may be, for example, a room, a house, an office building, a warehouse, or the like. In some embodiments, the HVAC system 100 is a packaged unit such as a rooftop unit (RTU) that is positioned on the roof of a building and the conditioned air is delivered to the interior of the building. In other embodiments, portion(s) of the system may be located within the building and portion(s) outside the building such as split systems used in commercial and residential applications. The HVAC system 100 may also include heating elements that are not shown here for convenience and clarity. The HVAC system 100 may be configured as shown in FIG. 1 or in any other suitable configuration. For example, the HVAC system 100 may include additional components or may omit one or more components shown in FIG. 1.

The HVAC system 100 includes a working-fluid conduit subsystem 102, a condensing unit 104, an expansion valve 114, an evaporator 116, a thermostat 134, and a controller 138. The working fluid conduit subsystem 102 facilitates the movement of a working fluid (e.g., a refrigerant) through a cooling cycle such that the working fluid flows as illustrated by the dashed arrows in FIG. 1. The working fluid may be any acceptable working fluid, or refrigerant, including, but not limited to, fluorocarbons (e.g. chlorofluorocarbons), ammonia, non-halogenated hydrocarbons (e.g. propane), hydrofluorocarbons (e.g. R-410A), A2L refrigerants, or any other suitable type of refrigerant. Without limitations, A2L refrigerants may include R-454b, R-32, R-1234yf, and R-1234zc.

The condensing unit 104 includes a compressor 106, a condenser 108, and a fan 110. The compressor 106 is coupled to the working-fluid conduit subsystem 102 and compresses (i.e., increases the pressure of) the working fluid. The compressor 106 may be configured to receive flow of refrigerant from an evaporator coil and to discharge the flow of refrigerant at a higher pressure. The compressor 106 of condensing unit 104 may be a variable speed compressor, a multi-speed compressor, a multi-stage compressor, among other types. In some embodiments, the compressor 106 may be connected to another compressor 106 in a HVAC unit. In some embodiments, multiple compressors 106 may be tandem compressors, each separately compressing the refrigerant and delivering the refrigerant to a common discharge manifold. In some embodiments, one or more compressors 106 may serve a single refrigeration circuit. In some embodiments, one or more compressors 106 may serve multiple refrigeration circuits. A variable speed compressor is generally configured to operate at different speeds to increase the pressure of the working fluid to keep the working fluid moving along the working-fluid conduit subsystem 102. In the variable speed compressor configuration, the speed of compressor 106 can be modified to adjust the cooling capacity of the HVAC system 100. Meanwhile, a multi-stage compressor may include multiple compressors, each configured to operate at a constant speed to increase the pressure of the working fluid to keep the working fluid moving along the working-fluid conduit subsystem 102. In the multi-stage compressor configuration, one or more compressors can be turned on or off to adjust the cooling capacity, heating capacity, or in general, air conditioning capacity of the HVAC system 100.

The compressor 106 is in signal communication with the controller 138 using a wired or wireless connection. The controller 138 provides commands or signals to control the operation of the compressor 106. For example, the controller 138 may operate the compressor 106 in different modes corresponding to load conditions (e.g., the amount of cooling or heating required by the HVAC system 100). The compressor 106 may be a motor-driven component. Accordingly, the controller 138 may provide a signal to a motor-drive circuit which powers a motor associated with the compressor 106. The controller 138 is described in greater detail below with respect to FIG. 2. The HVAC system 100 may include one or more condensing units 104 and one or more respective evaporators 116. Thus, the HVAC system 100 may include one or more compressors 106, one or more condensers 108, and one or more evaporators 116.

The condenser 108 is generally located downstream of the compressor 106 and is configured to remove heat from the working fluid. The fan 110 is configured to move air 112 across the condenser 108. For example, the fan 110 may be configured to blow outside air through the condenser 108 to help cool the working fluid flowing therethrough. The fan 110 may be in signal communication with the controller 138 using a wired or wireless connection such that the controller 138 provides commands or signals to control the operation of the fan 110. The fan 110 may be a motor-driven component. The controller 138 may provide a signal to a motor-drive circuit which powers a motor associated with the fan 110. The cooled working fluid from the condenser 108 flows toward an expansion valve 114.

The expansion valve 114 is coupled to the working-fluid conduit subsystem 102 downstream of the condenser 108 and is configured to remove pressure from the working fluid. In this way, the working fluid is delivered to the evaporator 116 and receives heat from airflow 118 to produce a conditioned airflow 120 that is delivered by a duct subsystem 122 to the conditioned space. In general, the expansion valve 114 may be a valve such as an expansion valve or a flow control valve (e.g., a thermostatic expansion valve (TXV) valve) or any other suitable valve for removing pressure from the working fluid while, optionally, providing control of the rate of flow of the working fluid. The expansion valve 114 may be in communication with the controller 138 (e.g., via wired and/or wireless communication) to receive control signals for opening and/or closing associated valves.

The evaporator 116 is generally any heat exchanger configured to provide heat transfer between air flowing through the evaporator 116 (i.e., contacting an outer surface of one or more evaporator coils associated with the evaporator 116) and working fluid passing through the interior of the evaporator 116. The evaporator 116 is fluidically connected to the compressor 106, such that working fluid generally flows from the evaporator 116 to the compressor 106.

A portion of the HVAC system 100 is configured to move air 118 across the evaporator 116 and out of the duct sub-system 122 as conditioned air 120. Return air 124, which may be air returning from the building, fresh air from outside, or some combination, is pulled into a return duct 126. A suction side of the blower 128 pulls the return air 124 through the duct 126. The blower 128 discharges airflow 118 into a duct 130 from where the airflow 118 crosses the evaporator 116 or heating elements (not shown) to produce the conditioned airflow 120. The blower 128 is any mechanism for providing a flow of air through the HVAC system 100. For example, the blower 128 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers.

The blower 128 is in signal communication with the controller 138 using any suitable type of wired or wireless connection. The controller 138 is configured to provide commands or signals to the blower 128 to control its operation. The blower 128 may be a motor-driven component. The blower 128 may be positioned in a duct system and configured to move airflow across an indoor coil and out of the duct system. The controller 138 may provide a signal to a motor-drive circuit which powers a motor associated with the blower 128.

The HVAC system 100 generally includes one or more sensor circuits 132*a-c* in signal communication with the controller 138. The sensors 132*a-c* may include any suitable type of sensor for measuring air temperature as well as other properties of a conditioned space (e.g., a room or building). The sensors 132*a-c* may be positioned anywhere within the conditioned space, the HVAC system 100, and/or the surrounding environment. For example, as shown in the illustrative example of FIG. 1, the HVAC system 100 may include a sensor circuits 132*a* positioned adjacent to the blower 128 and configured to measure a return air temperature (e.g., of airflow 124), a sensor circuits 132*b* positioned downstream the evaporator 116 and configured to measure a supply or treated air temperature (e.g., of airflow 120), a sensor circuits 132*c* may be positioned upstream or downstream of the evaporator 116 and configured to measure airflow temperature (e.g., of the airflow 118). The sensor circuit 132*c* may be positioned adjacent to the duct system and configured to detect a concentration of refrigerant in a volume.

Each sensor circuit 132*a-c* may be implemented by a hardware sensor circuitry. Each sensor circuits 132*a-c* may be any suitable sensor and/or collection of equipment operable to detect a concentration of refrigerant, air temperature, air pressure, among others. Without limitations, each sensor circuit 132*a-c* may be one or more of a gas sensor circuit, temperature sensor circuit, speed of sound sensor circuit, pressure sensor circuit, thermal conductivity sensor circuit, heated diode leak detector circuit, or any combination thereof. In some embodiments where a sensor circuit 132 is configured to detect refrigerant, the sensor circuit 132 may be interchangeably referred to herein as a refrigerant detection sensor circuit 132. In some embodiments, the sensor circuit 132*a-c* may be in signal communication with a controller 138 using a wired or wireless connection.

The controller 138 may be configured to provide commands or signals to control the operation of the HVAC system 100. For example, the controller 138 may be configured to receive a plurality of concentration measurements from the refrigerant detection sensor 132*a-c*. In this example, the controller 138 may transmit instructions to the blower 128 based on a determination that the concentration of refrigerant in the HVAC system 100 exceeds a stored threshold value. In other examples, the HVAC system 100 may include sensors positioned and configured to measure any other suitable type of air temperature (e.g., the temperature of air at one or more locations within the conditioned space and/or an outdoor air temperature), refrigerant concentration in air or otherwise refrigerant presence, among others.

The HVAC system 100 includes one or more thermostats 134, for example, located within the conditioned space (e.g., a room or building). The thermostat 134 is generally in signal communication with the controller 138 using any suitable type of wired or wireless communications. The thermostat 134 may be a single-stage thermostat, a multi-stage thermostat, or any suitable type of thermostat as would be appreciated by one of ordinary skill in the art. The thermostat 134 is configured to allow a user to input a desired temperature via a temperature setpoint 136 for a designated space or zone such as a room in the conditioned space. The controller 138 may use information from the thermostat 134 such as the temperature setpoint 136 for controlling the compressor 106, the fan 110, and/or the blower 128.

As described above, in certain embodiments, connections between various components of the HVAC system 100 are wired. For example, conventional cable and contacts may be used to couple the controller 138 to the various components of the HVAC system 100, including, the compressor 106, the fan 110, the expansion valve 114, the blower 128, sensor(s) 132, and thermostat 134. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 138 to other components of the HVAC system 100.

Example Refrigerant Leak Detection System

FIG. 2 illustrates an example embodiment of a system 200 configured to detect refrigerant leak at any component 202 of the HVAC system 100 and provide cooling with one or more compressor 106*a-c* during the refrigerant leak. In some examples, the components 202 may include refrigeration circuit 206*a-c*, among other component of the HVAC system 100 described in FIG. 1. In certain embodiments, the system 200 comprises a controller 240, refrigerant detection sensors circuits 132*a-c*, components 202 of the HVAC system 100, and the blower 128. The controller 240 corresponds to the controller 138 described in FIG. 1. Each refrigeration circuit 206*a-c* may be an instance of the refrigeration circuit 206. Each refrigeration circuit 206 may include one or more compressors 106, evaporator 116, condenser 108, and expansion valve, among other components described in FIG. 1. For example, in some embodiments of the HVAC system 100 of FIG. 1, the HVAC system 100 may include multiple refrigeration circuits 206*a-c* configured to provide air conditioning (e.g., cooling or heating) to a room where the HVAC system 100 is installed. The controller 240 is in signal communication with each of the refrigerant sensor circuits 132*a-c*, components 202, and the blower 128 via wires and/or wireless connection. In some embodiments, the refrigerant leak detection system 200 may be installed or deployed on a refrigeration system, such as the HVAC system 100 of FIG. 1. In some embodiments, the refrigerant leak detection system 200 may be installed or deployed on any refrigeration system, such as chillers, HVAC units, and the like. In embodiments where the refrigerant leak detection system 200 is installed on the refrigeration system 100, the refrigeration system 100 may include the refrigerant leak detection system 200.

In general, the system 200 improves the refrigeration techniques by enabling to provide air conditioning even when a refrigerant leak is detected. The refrigerant may be flammable or at least mildly flammable, such as A2L, or toxic. Therefore, it is crucial to detect and address A2L refrigerant leaks in a timely manner. In one approach, when a refrigerant leak is detected at any component of an HVAC system 100, the cooling unit (e.g., compressor circuit(s)) of the HVAC system is switched off and the blower 128 is switched on to dilute the refrigerant concentration that is present within the HVAC system 100. However, this approach suffers from several drawbacks. For example, switching off the cooling unit of the HVAC system 100 leads to a temperature rise in a room where the HVAC system 100 is deployed, and therefore, discomfort for the people in the room. In another example, with this approach, after the blower is switched on, the blower causes airflow from within the HVAC system to the outside which dilutes the refrigerant concentration. This operation may be referred to as a mitigation plan to dilute the refrigerant concentration. In response to detecting that the refrigerant concentration is diluted, the blower may be switched off. When an air conditioning demand is received, for example, from a user, the compressor circuit is ready to be switched on to satisfy the demand. However, this refrigerant dilution may be temporary if the refrigerant leak is consistent and/or the refrigerant leak rate is significant. In other words, if the refrigerant leak is consistent and/or the refrigerant leak rate is significant, the concentration of the refrigerant within the HVAC system may increase after the blower is switched off. In some cases, the mitigation plan cycle may repeat multiple times when the refrigerant leak is consistent and/or the refrigerant leak rate is significant. Current technology does not provide a solution to address multiple repetitions of the mitigation plan cycles. As a result, the blower may continue to be switched on and off. This frequent switching on and off operations may impact the life of refrigeration circuit components, including the blower, and the compressor, among others.

This disclosure contemplates an unconventional system and method configured to provide air conditioning with one or more compressor circuits HVAC system 100 during A2L (or other classes of flammable or mildly flammable) refrigerant leak. The disclosed system 200 is configured to detect a number of times 258 that refrigerant leak 204 has occurred within the HVAC system 100. The number of times 258 of occurrences of the refrigerant leak 204 may be one, two, three, four, or any suitable number. If it is determined that the number of times 258 that refrigerant leak 204 has occurred is more than a threshold value 248, the disclosed system 200 may operate the HVAC system 100 in safe mode 250. The safe mode 250 may be a mode of operation of the HVAC system 100 in which the blower 128 operates continuously. The disclosed system 200 may continue to monitor refrigerant leaks at the refrigeration circuits 206*a-c*. If a subsequent refrigerant leak 204 is detected while the HVAC system 100 is operating in the safe mode 250, the disclosed system 200 may determine that the leak is significant enough such that even the blower 128 is switched on, it is not enough to dilute the refrigerant concentration or accumulation. In response, the system 200 may transmit an alert message, for example, to a user device 270 associated with a technician to provide a service to the HVAC system 100. In some embodiments, the refrigerant detection sensor circuits 132*a-c* may be positioned within a space that is shared by multiple components 202 (e.g., multiple compressor circuits 106*a-n*). Therefore, in such embodiments, the location of the leak may not be determined from the data captured by the refrigerant detection sensor circuits 132*a-c*. For example, in large HVAC systems 100, it may not be feasible if a sensor circuit 132*a-c* is placed at each refrigeration circuit 206*a-n* because that may require a large number of sensors 132*a-c* to be implemented, which adds complexity to control and monitoring the HVAC system. The disclosed system is configured to provide air conditioning by one or more compressor circuits 106*a-n* that may or may not be associated with the leak regardless of the location of the leak or a component from which the refrigerant is leaking.

Accordingly, the disclosed system 200 provides a practical application of improving the refrigeration techniques by allowing cooling even if an A2L refrigerant leak is detected. For example, if the HVAC system 100 is a multi-compressor system, the system 200 may switch off the faulty component associated with the refrigeration circuit 206 (that is associated with the refrigerant leak) and, upon receiving an air conditioning (e.g., cooling or heating) request from a user, switch on one or more other compressors 106 that are not associated with a refrigerant leak. In another example, if the HVAC system 100 is a single-compressor system, the system 200 may keep the faulty component associated with the refrigeration circuit 206 on and also keep the blower 128 on. Thus, the blower 128 may continue to dilute the refrigerant concentration to bring the refrigeration concentration less than the threshold concentration 252 according to safety compliance standards to keep the HVAC system 100 in a safe condition and does not trigger the refrigerant detection sensors 132*a-c* to detect the refrigerant leaks.

Refrigerant Detection Sensor

Each of the sensors 132*a-c* may be a sensor circuitry that is configured to detect refrigerant concentration in a volume. For example, each sensor 132*a-c* may include a circuit board comprising electronic devices and is configured to detect refrigerant particles in the air and monitor the presence of refrigerant particles (e.g., refrigerant gases) in the air. In some examples, each sensor 132*a-c* may be a gas sensor configured to detect refrigerant particles in the air. In some examples, each sensor 132*a-c* may include a sensing element, such as transistors that when exposed to at least a threshold concentration 252 of refrigerant particles in the air (e.g., a number of refrigerant particles per unit space volume) may detect the presence of the refrigerant particles. Each sensor 132*a-c* may detect the refrigerant leak from the refrigerant particles in the air when the detected concentration of refrigerant is more than the threshold concentration 252 of the refrigerant. For example, the threshold concentration 252 the refrigerant maybe 10% of lower flammability limit (LFL), 12% of LFL, 15% of LFL, and the like. The sensor 132*a-c* may detect the refrigerant within its detection range. The detection range of the sensor 132*a-c* maybe five inches, ten inches, twenty inches, and the like.

Certain properties of A2L refrigerants, such as flammability, may be related to how concentrated a given refrigerant is within a volume. To meet compliance standards, the system 200 may be configured to determine when a LFL of a refrigerant exceeds a threshold value within a specified period of time (e.g., 12% of LFL in one minute, two minutes, etc.). The system 200 may further be configured to reduce the LFL of the refrigerant if there is a determination that the LFL exceeds the threshold value within a specified period of time. In one example, the A2L refrigerant may be R454B. In this example, if it is determined that the A2L refrigerant concentration is at least 310 grams per one meter-cube, the LFL of the A2L refrigerant is 100%. Consequently, if a potential ignition source approaches the vicinity of the cubic meter containing the A2L refrigerant, it will give rise to combustion. Thus, it is desired to have the threshold concentration 252 at a much lower % LFL.

Controller

The controller 240 may correspond to the controller 138 described in FIG. 1. Aspects of the controller 240 are described in FIG. 1, and additional aspects are described in FIG. 2. The controller 240 may be a computing device that is configured to perform one or more operations described herein. The controller 240 includes a processor 242 in signal communication with an Input/Output interface 244 and a memory 246. The components of the controller 240 are in signal communication with each other.

The processor 242 includes one or more processors operably coupled to the memory 246 and I/O interface 244. The processor 242 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 246 and controls the operation of refrigeration system 100. The processor 242 may be a programmable logic device, a microcontroller, a microprocessor, or any suitable combination of the preceding. The processor 242 is communicatively coupled to and in signal communication with the memory 246. The one or more processors are configured to process data and may be implemented in hardware or software. For example, the processor 242 may be 8-bit, 16-bit, 32-bit, 64-bit or of any other suitable architecture. The processor 242 may include an arithmetic logic unit (ALU) for performing arithmetic and logic operations, processor registers that supply operands to the ALU and store the results of ALU operations, and a control unit that fetches instructions from memory 246 and executes them by directing the coordinated operations of the ALU, registers, and other components. The processor 242 may include other hardware and software that operates to process information, control the refrigeration system 100, and perform any of the functions described herein (e.g., with respect to FIGS. 1-3) by executing the software instructions 249. The processor 242 is not limited to a single processing device and may encompass multiple processing devices. Similarly, the controller 240 is not limited to a single controller but may encompass multiple controllers.

The I/O interface 244 is configured to communicate data and signals with other devices. For example, the I/O interface 244 may be configured to communicate electrical signals with components of the refrigeration system 100 including the sensor 132*a-c* and components 202, among other components. The I/O interface 244 may be configured to communicate with other devices and systems. The I/O interface 244 may provide and/or receive, for example, compressor speed signals, compressor on/off signals, temperature signals, pressure signals, temperature setpoints, environmental conditions, and an operating mode status for the refrigeration system 100 and send electrical signals 266, 272 to the components of the refrigeration system 100 and send alert message 260, 262 to administrators, technicians, or other users. The I/O interface 244 may include ports or terminals for establishing signal communications between the controller 240 and other devices. The I/O interface 244 may be configured to enable wired and/or wireless communications.

The memory 246 may be a non-transitory computer-readable medium and include one or more disks, tape drives, or solid-state drives, and may be used as an over-flow data storage device, to store programs when such programs are selected for execution, and to store instructions and data that are read during program execution. The memory 246 may be volatile or non-volatile and may include ROM, RAM, ternary content-addressable memory (TCAM), dynamic random-access memory (DRAM), and static random-access memory (SRAM). The memory 246 is operable (e.g., or configured) to store information used by the controller 240 and/or any other logic and/or instructions for performing the function described in this disclosure. For example, the memory 246 may store instructions 249 for performing the functions of the controller 240 described in this disclosure. For example, when the instructions 249 are executed by the processor 242, the instructions 249 cause the processor 242 to perform one or more operations of the controller 240 described herein. The memory 246 may further store sensor data 256*a-c*, threshold concentration 252, mitigation plan 254, threshold value 248, safe mode 250, counter parameter 264, switch-on command signal 266, shut-off command signal 272, number of times 258, alert messages 260, 262, and any other data/instruction. These components are described further below in conjunction with the operational flow of the system 200.

Operational Flow

At the initial operation of the HVAC system 100, the safe mode 250 is not active. In operation, the controller 240 may receive sensor data 256*a-c* from the refrigerant detection sensor circuits 132*a-c*. The sensor data 256*a-c* may include a set of refrigerant concentration per volume values detected by the refrigerant detection sensor circuits 132*a-c*. Each sensor data 256*a-c* may be associated with a single refrigeration detection sensor circuit 132*a-c*. For example, the sensor data 256*a* may be received from the refrigeration detection sensor circuit 132*a*, the sensor data 256*b* may be received from the refrigeration detection sensor circuit 132*b*, and the sensor data 256*c* may be received from the refrigeration detection sensor circuit 132*c*. Each of the refrigerant detection sensor circuits 132*a-c* may be positioned at any location within the HVAC system 100, for example, upstream a compressor 106 (see FIG. 1), downstream a compressor 106 (see FIG. 1), upstream the evaporator 116 (see FIG. 1), downstream the evaporator 116 (see FIG. 1), among other locations.

In some embodiments, the refrigerant detection sensor circuit 132*a-c* may be positioned in the space that is shared by multiple refrigeration circuits 206*a-c*. In some embodiments, each refrigerant detection sensor circuit 132*a-c* may be associated with a single refrigeration circuit 206*a-c*. For example, the refrigerant detection sensor circuit 132*a* may be associated with and positioned downstream or upstream the compressor or downstream or upstream of the evaporator associated with the refrigeration circuit 206*a*, the refrigerant detection sensor circuit 132*b* may be associated with and positioned downstream or upstream the compressor or downstream or upstream of the evaporator associated with the refrigeration circuit 206*b*, and the refrigerant detection sensor circuit 132*c* may be associated with and positioned downstream or upstream the compressor or downstream or upstream of the evaporator associated with the refrigeration circuit 206*c*. The controller 240 may perform the following operations with respect to each sensor data 256*a-c* received from a respective refrigerant detection sensor circuit 132*a-c*. In other words, the controller 240 may evaluate whether there is a refrigerant leak 204 at each of the refrigeration circuits 206*a-c*. In this manner, the controller 240 may obtain information about the concentration of the refrigerant in volume from the sensor data 132*a-c*. In certain embodiments, the sensor 132*a-c* may be configured to obtain information about the concentration of the refrigerant in volume from the sensor data 132*a-c*, compare the detected concentration of refrigerant with the threshold concentration 252, determine whether the detected concentration of refrigerant exceeds the threshold concentration 252, and communicate a signal indicating the result to the controller 240.

Determining Whether a Refrigerant Leak is Detected

In the example below, the controller 240 evaluates whether a refrigerant leak is detected by any of the refrigerant detection sensor circuits 132*a-c* as indicated by any of the sensor data 256*a-c*. The controller 240 may perform a similar operation for each sensor data 256*a-c* in parallel or in series. The controller 240 may compare the detected concentration of refrigerant received from the refrigerant detection sensor circuit 132*a* with the threshold concentration 252. The controller 240 may determine whether the detected concentration of refrigerant exceeds the threshold concentration 252. If it is determined that the detected concentration of refrigerant exceeds the threshold concentration 252, the controller 240 may determine that a refrigerant leak 204 is indicated by the sensor data 256*a*. The controller 240 may perform the leak detection operation on multiple occasions whenever each sensor data 256*a-c* is received. For example, the sensor data 256*a-c* may be, respectively, received from the refrigerant detection sensors 132*a-c* every minute, every thirty seconds, every ten seconds, and the like. The location of the refrigerant leak 204 may or may not be known from the sensor data 256*a-c*. The controller 240 may perform similar operations to evaluate whether there is a refrigerant leak 204 at any other compressor circuits 106*b-c*.

In response to determining that the refrigerant leak 204 is detected, the controller 240 may execute the mitigation plan 254 until the detected refrigerant concentration is less than the threshold concentration 252. The mitigation plan 254 may include switching on the blower 128 and switching off the compressor 106 if it is energized. Further, in response to determining that the refrigerant leak 204 is detected, the controller 240 may communicate a first alert message 260. The first alert message 260 may indicate that the refrigerant leak 204 is detected. The first alert message 260 may further indicate that the HVAC system 100 needs service. The controller 240 may communicate the first alert message 260 to the user device 270 that is associated with a technician or the like.

Determining Whether the Safe Mode is Active

The controller 240 may determine whether the HVAC system 100 is operated (or operates) in the safe mode 250, where in the safe mode 250, the blower 128 is set to continuously run/operate. In other words, in the safe mode 150, the blower 128 may be switched on regardless of whether a subsequent occurrence of refrigerant leak is detected. If the controller 240 determines that the HVAC system 100 does not operate in the safe mode 250, the controller 240 may perform the following operations. The controller 240 may determine a number of times 258 when the detected concentration of refrigerant exceeded the threshold concentration 252. If the controller 240 determines that the number of times 258 when the detected concentration of refrigerant exceeded the threshold concentration 252 is more than a threshold value 248, the controller 240 may operate the HVAC system 100 in safe mode 250 . . . . If the controller 240 determines that the number of times 258 when the detected concentration of refrigerant exceeded the threshold concentration 252 is less than the threshold value 248, the controller 240 may continue to monitor refrigerant leaks by evaluating the upcoming sensor data 256*a-c*.

In certain embodiments, if the controller 240 detects a refrigerant leak 204 and determines that the HVAC system 100 is operating in the safe mode 250, the controller 240 may determine that there is a significant leak and/or the refrigerant leak is consistent such that even the blower 128 is not able to dilute the concentration of the refrigerant to below the threshold value 248 within a certain period. In such cases, the controller 240 may determine that it is not safe to operate HVAC system 100 with the refrigerant leak 204. In response, the controller 240 may communicate a second alert message 262 that indicates that the refrigerant leak 204 is detected and has been consistent for the number of times 258, and that the HVAC system 100 needs service. The controller 240 may communicate the second alert message 262 to the user device 270 associated with a technician.

In certain embodiments, when the controller 240 determines that the HVAC system 100 does not operate in the safe mode 250, the controller 240 may increase a counter parameter 264 by one, each time/occasion that the concentration of the refrigerant is determined to exceed the threshold concentration 252. In other words, the controller 240 may increase the counter number parameter 264 by one, each time the refrigerant leak 204 is detected. The controller 240 may determine whether the counter parameter 264 has reached a threshold value 248. If it is determined that the counter parameter 264 has reached the threshold value 248, the controller 240 may operate the HVAC system 200 in the safe mode 250. For example, to this end, the controller 240 may communicate the switch-on command signal 266 to the blower 128 which causes the blower 128 to operate/run continuously.

Operating the HVAC system 100 in the safe mode 250 may allow air conditioning even if a refrigerant leak is present. In one example, if the HVAC system 100 is a single-compressor circuit system and has only the refrigeration circuit 206*a*, the HVAC system 100 may provide air conditioning by switching on the refrigeration circuit 206*a*. In another example, if the HVAC system 100 is a multi-compressor circuit system, the HVAC system 100 may provide air conditioning by one or more refrigeration circuits 206*a-c* where there may or may not be a refrigerant leak. Thus, even if there is a refrigerant leak at the refrigeration circuit 206*a*, the HVAC system 100 may still be able to provide air conditioning in both examples.

In certain embodiments, if the HVAC system 100 is a single-compressor circuit system and the controller 240 receives a request to turn on the compressor 106 (e.g., to provide air conditioning), the controller 240 may communicate a turn-on command signal to the refrigeration circuit 206*a* that causes the refrigeration circuit 206*a* to turn on.

In certain embodiments, if the HVAC system 100 is a multi-compressor circuit system and the controller 240 receives a request to turn on the compressor 106 (e.g., to provide air conditioning), the controller 240 may communicate a turn-on command signal to one or more refrigeration circuits 206*a-c* where no refrigerant leak is detected that causes the one or more refrigeration circuits 206*a-c* to turn on.

In certain embodiments, a processor (e.g., similar to processor 242) may be integrated and embedded within the refrigerant detection sensor 132*a-c*. In such embodiments, the refrigerant detection sensor 132*a-c* may be configured with the threshold concentration 252 and indicate information about whether the refrigerant concentration is more than the threshold concentration 252 in sensor data 256*a-c*. For example, when a refrigerant concentration more than the threshold concentration 252 is detected by the sensor 132*a-c*, the refrigerant detection sensor 132*a-c* may include a signal (e.g., a flag bit) indicating that an above-threshold concentration is detected to the controller 240 in the sensor data 256*a-c*, respectively. Otherwise, if the refrigerant detection sensor 132*a-c* detects that the refrigerant concentration is less than the threshold concentration 252, the refrigerant detection sensor 132*a-c* may include a signal indicating that a less than the threshold concentration 252 of refrigerant is detected to the controller 240 in the sensor data 256*a-c*, respectively. In response to receiving the sensor data 156*a-c* indicating that above the threshold concentration 252 of refrigerant is detected, the controller 240 may execute the mitigation plan 254 and other operations similar to that described above.

Example Method for Providing Cooling During Refrigerant Leak

FIG. 3 illustrates an example method 300 of system 200 of FIG. 2 for providing cooling during refrigerant leak, according to some embodiments. Modifications, additions, or omissions may be made to method 300. Method 300 may include more, fewer, or other operations. For example, operations may be performed in parallel or in any suitable order. While at times discussed as the system 100, system 200, sensor 132*a-c*, controller 240, or components of any of thereof performing operations, any suitable system or components of the system may perform one or more operations of the method 300. In certain embodiments, a processor (e.g., a processor embedded inside the sensor 132*a-c* and/or the processor 242) may perform one or more operations of the method 300. For example, one or more operations of method 300 may be implemented, at least in part, in the form of software instructions 249 of FIG. 2, stored on a non-transitory computer-readable medium (e.g., memory 246 of FIG. 2) that when run by one or more processors (e.g., processor 242 of FIG. 2) may cause the one or more processors to perform operations 302-316.

At operation 302, the controller 240 determines whether a refrigerant leak 204 is detected. For example, the controller 240 may receive the sensor data 256*a-c* from the refrigerant detection sensors 132*a-c* and determine whether the refrigerant concentration detected by each refrigeration detection sensor 132*a-c* is more than the threshold concentration 252. If the controller 240 determines that the refrigerant concentration is more than the threshold concentration 252, the controller 240 may determine that a refrigerant leak is detected by the respective refrigerant detection sensor 132*a-c* associated with a respective refrigeration circuit 206*a-c*, similar to that described in FIG. 2. If it is determined that the refrigerant leak is detected, method 300 proceeds to operation 304. Otherwise, the method 300 remains at operation 302.

At operation 304, the controller 240 executes the mitigation plan 254. The mitigation plan 254 may include switching on the blower 128 by communicating a turn-on command signal 266 to the blower 128. Additionally, if the compressor associated with the refrigeration circuit 106*a* is energized, it may be switched off. For example, the mitigation plan 254 may additionally include communicating the shut-off command signal 272 to the compressor associated with the refrigeration circuit 106*a* if the compressor is energized.

At operation 306, the controller 240 communicates a first alert message 260, for example, to the user device 270 associated with a technician, where the first alert message 260 may indicate that the refrigerant leak 204 is detected, similar to that described in FIG. 2.

At operation 308, the controller 240 determines whether the HVAC system 100 operates in the safe mode 250. For example, the controller 240 may determine that the HVAC system 100 operates in the safe mode 250 if controller 240 has already sent the switch-on command signal 266 to the blower 128. Otherwise, the controller 240 may determine that the HVAC system 100 is not operating in the safe mode 250. If it is determined that the HVAC system 100 is operating in safe mode 250, method 300 proceeds to operation 310. Otherwise, method 300 proceeds to operation 312.

At operation 310, the controller 240 communicates the second alert message 262, for example, to the user device 270 of a technician, where the alert message 262 indicates that the refrigerant leak 204 is detected with respect to the refrigeration circuit 206*a* while the blower 128 is turned on. and it is not safe to energize the compressor 106 associated with the refrigeration circuit 206*a*.

At operation 312, the controller 240 increases the counter parameter 264 by one. At operation 314, the controller 240 determines whether the counter parameter 264 is more than the threshold value 248. If it is determined that the counter parameter 264 is more than (or equal to) the threshold value 248, the method 300 proceeds to operation 316. Otherwise, the method 300 returns to operation 302.

At operation 316, the controller 240 operates the HVAC system 100 in the safe mode 250. For example, the controller 240 may communicate the switch-on command signal 266 to the blower 128 which causes the blower 128 to operate/run continuously. The method 300 may then return to operation 302.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated with another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

The invention claimed is:

1. A heating, ventilation, and air conditioning (HVAC) system configured to regulate a temperature of a space, the HVAC system comprising:
- a blower positioned in a duct system, wherein the blower is configured to move airflow across an indoor coil and out of the duct system;
- a refrigerant detection sensor circuit configured to detect a concentration of refrigerant in a volume; and
- one or more processors associated with the refrigerant detection sensor, and configured to:
  - for at least two occasions:
    - obtain information related to the detected concentration of the refrigerant in the volume;
    - compare the detected concentration of refrigerant with a threshold concentration; and
    - determine that the detected concentration of refrigerant exceeds the threshold concentration;
  - execute a mitigation plan until the detected concentration of refrigerant is less than the threshold concentration;
  - in response to determining that the HVAC system does not operate in a safe mode, wherein, in the safe mode, the blower of the HVAC system is set to operate continuously:
    - determine a number of times where the detected concentration of refrigerant exceeded the threshold concentration;
    - determine whether the number of times where the detected concentration of refrigerant exceeded the threshold concentration is more than a threshold value; and
    - in response to determining that the number of times where the detected concentration of refrigerant exceeded the threshold concentration is more than the threshold value:
      - operate the HVAC system in the safe mode; and
      - communicate a first alert message, wherein the first alert message indicates a refrigerant leak is detected.

2. The HVAC system of claim 1, wherein the processor is further configured to communicate a second alert message, wherein the second alert message indicates that a refrigerant leak is detected while the blower is turned on.

3. The HVAC system of claim 1, wherein the processor is further configured to:
- in response to determining that the HVAC system does not operate in the safe mode:
  - increase a counter parameter by one each time the concentration of refrigerant exceeds the threshold concentration;
  - determine whether the counter parameter has reached the threshold value; and
  - in response to determining that the counter parameter has reached the threshold value, operate the HVAC system in the safe mode.

4. The HVAC system of claim 1, further comprising a compressor configured to receive flow of refrigerant from an evaporator coil and to discharge the flow of refrigerant at a higher pressure.

5. The HVAC system of claim 4, wherein the processor is further configured to:
- while the HVAC system operates in the safe mode, receive a request to turn on the compressor; and
- in response to receiving the request, turn on the compressor.

6. The HVAC system of claim 4, wherein the mitigation plan comprises:
- turning off the compressor if the compressor is energized; and
- turning on the blower.

7. The HVAC system of claim 1, wherein the one or more processors is integrated into the refrigerant detection sensor or external to the refrigerant detection sensor.

8. A method for operating a heating, ventilation, and air conditioning (HVAC) system configured to regulate a temperature of a space, the method comprising: for at least two occasions: obtaining information related to a detected concentration of a refrigerant in a volume; comparing the detected concentration of refrigerant with a threshold concentration; and determining that the detected concentration of refrigerant exceeds the threshold concentration; executing a mitigation plan until the detected concentration of refrigerant is less than the threshold concentration; in response to determining that the HVAC system does not operate in a safe mode, wherein, in the safe mode, a blower of the HVAC system is set to operate continuously: determining a number of times where the detected concentration of refrigerant exceeded the threshold concentration; determining whether the number of times where the detected concentration of refrigerant exceeded the threshold concentration is more than a threshold value; and in response to determining that the number of times where the detected concentration of refrigerant exceeded the threshold concentration is more than the threshold value: operating the HVAC system in the safe mode; and communicating a first alert message, wherein the first alert message indicates a refrigerant leak is detected.

9. The method of claim 8, further comprising communicating a second alert message, wherein the second alert message indicates that a refrigerant leak is detected while the blower is turned on.

10. The method of claim 8, further comprising:

in response to determining that the HVAC system does not operate in the safe mode:

increasing a counter parameter by one each time the concentration of refrigerant exceeds the threshold concentration;

determining whether the counter parameter has reached the threshold value; and in response to determining that the counter parameter has reached the threshold value, operating the HVAC system in the safe mode.

11. The method of claim 8, further comprising receiving, at a compressor, flow of refrigerant from an evaporator coil and to discharge the flow of refrigerant at a higher pressure.

12. The method of claim 11, further comprising:

while the HVAC system operates in the safe mode, receiving a request to turn on the compressor; and in response to receiving the request, turning on the compressor.

13. The higher pressure of claim 11, wherein the mitigation plan comprises:

turning off the compressor if the compressor is energized; and turning on the blower.

14. The method of claim 8, wherein the refrigerant is flammable, mildly flammable, or toxic.

15. A non-transitory computer-readable medium storing instructions that when executed by a processor, cause the processor to:

for at least two occasions:

obtain information related to a detected concentration of a refrigerant in a volume;

compare the detected concentration of refrigerant with a threshold concentration; and determine that the detected concentration of refrigerant exceeds the threshold concentration;

execute a mitigation plan until the detected concentration of refrigerant is less than the threshold concentration;

in response to determining that a heating, ventilation, and air conditioning (HVAC) system does not operate in a safe mode, wherein, in the safe mode, a blower of the HVAC system is set to operate continuously:

determine a number of times where the detected concentration of refrigerant exceeded the threshold concentration;

determine whether the number of times where the detected concentration of refrigerant exceeded the threshold concentration is more than a threshold value; and in response to determining that the number of times where the detected concentration of refrigerant exceeded the threshold concentration is more than the threshold value:

operate the HVAC system in the safe mode; and communicate a first alert message, wherein the first alert message indicates a refrigerant leak is detected.

16. The non-transitory computer-readable medium of claim 15, wherein the instructions further cause the processor to communicate a second alert message, wherein the second alert message indicates that a refrigerant leak is detected while the blower is turned on.

17. The non-transitory computer-readable medium of claim 15, wherein the instructions further cause the processor to:

in response to determining that the HVAC system does not operate in the safe mode:

increase a counter parameter by one each time the concentration of refrigerant exceeds the threshold concentration;

determine whether the counter parameter has reached the threshold value; and in response to determining that the counter parameter has reached the threshold value, operate the HVAC system in the safe mode.

18. The non-transitory computer-readable medium of claim 15, wherein the instructions further cause the processor to receive, at a compressor, flow of refrigerant from an evaporator coil and to discharge the flow of refrigerant at a higher pressure.

19. The non-transitory computer-readable medium of claim 18, wherein the instructions further cause the processor to:

while the HVAC system operates in the safe mode, receiving a request to turn on the compressor; and in response to receiving the request, turning on the compressor.

20. The non-transitory computer-readable medium of claim 18, wherein the processor is integrated into the refrigerant detection sensor or external to the refrigerant detection sensor.

* * * * *